US008920692B2

(12) United States Patent
Landry-Coltrain et al.

(10) Patent No.: US 8,920,692 B2
(45) Date of Patent: Dec. 30, 2014

(54) METHOD FOR RECYCLING RELIEF IMAGE ELEMENTS

(75) Inventors: Christine Joanne Landry-Coltrain, Fairport, NY (US); Linda M. Franklin, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 931 days.

(21) Appl. No.: 13/053,717

(22) Filed: Mar. 22, 2011

(65) Prior Publication Data

US 2012/0242011 A1 Sep. 27, 2012

(51) Int. Cl.
*H05B 6/00* (2006.01)
*B41C 1/05* (2006.01)
*B41N 3/00* (2006.01)

(52) U.S. Cl.
CPC .. *B41N 3/006* (2013.01); *B41C 1/05* (2013.01)
USPC ..... 264/37.1; 264/400; 425/174.4; 430/329; 430/301

(58) Field of Classification Search
CPC ..... B41C 1/05; B41C 1/00; B41N 1/00; B41F 5/24
USPC ..... 264/400, 37.1; 425/174.4; 430/300, 430/301, 329, 56, 96, 270.1; 101/401.1, 101/368, 395
See application file for complete search history.

(56) References Cited

U.S. PATENT DOCUMENTS 5,071,686 A * 12/1991 Genske et al. ..... 428/35.7
5,552,261 A * 9/1996 Kraska et al. ..... 430/273.1
6,776,095 B2 8/2004 Telser et al.
6,911,300 B2 * 6/2005 Sato et al. ..... 430/307
6,930,152 B2 8/2005 Hashimoto et al.
7,101,653 B2 9/2006 Kaczun et al.
7,152,529 B2 * 12/2006 Gotsick et al. ..... 101/401.1
7,253,234 B2 8/2007 Mori et al.
7,290,487 B2 11/2007 Hiller
7,811,744 B2 10/2010 Figov
8,007,902 B2 * 8/2011 Smith ..... 428/220
8,603,725 B2 * 12/2013 Landry-Coltrain et al. ..... 430/270.1
2007/0051262 A1 * 3/2007 Gotsick et al. ..... 101/401.1
2008/0220193 A1 9/2008 Tohi et al.
2008/0241663 A1 10/2008 Yamashita et al.
2008/0261028 A1 * 10/2008 Regan et al. ..... 428/336

(Continued)

FOREIGN PATENT DOCUMENTS

EP 1958968 A1 * 12/2006 ..... C08F 2/44
EP 1 958 968 8/2008
EP 2 241 603 10/2010

OTHER PUBLICATIONS

U.S. Appl. No. 13/053,700 filed Mar. 22, 2011, titled "Laser-Engraveable Flexographic Printing Precursors" by C.J. Landry-Coltrain et al.

*Primary Examiner* — Joseph S Del Sole
*Assistant Examiner* — Nahida Sultana
(74) *Attorney, Agent, or Firm* — J. Lanny Tucker

(57) ABSTRACT

Used flexographic printing members and unused flexographic printing precursors can be recycled for reuse. This recycling can be achieved by melting a laser-engraveable layer of a flexographic printing precursor or a laser-engraved layer of a flexographic printing member to form a melt, and reforming the melt into a new laser-engravable flexographic printing precursor. The laser-engraveable layer or laser-engraved layer comprises one or more thermoplastic elastomeric nanocrystalline polyolefins that can also be mixed with non-nanocrystalline polymers.

15 Claims, 1 Drawing Sheet

(56) References Cited

U.S. PATENT DOCUMENTS

2009/0202758 A1* 8/2009 Hiruma et al. ..... 428/34.9
2010/0068470 A1 3/2010 Sugasaki
2012/0240802 A1* 9/2012 Landry-Coltrain et al. .. 101/483
2012/0242011 A1* 9/2012 Landry-Coltrain et al. .. 264/480
2013/0029102 A1* 1/2013 Landry-Coltrain et al. .. 428/159

* cited by examiner

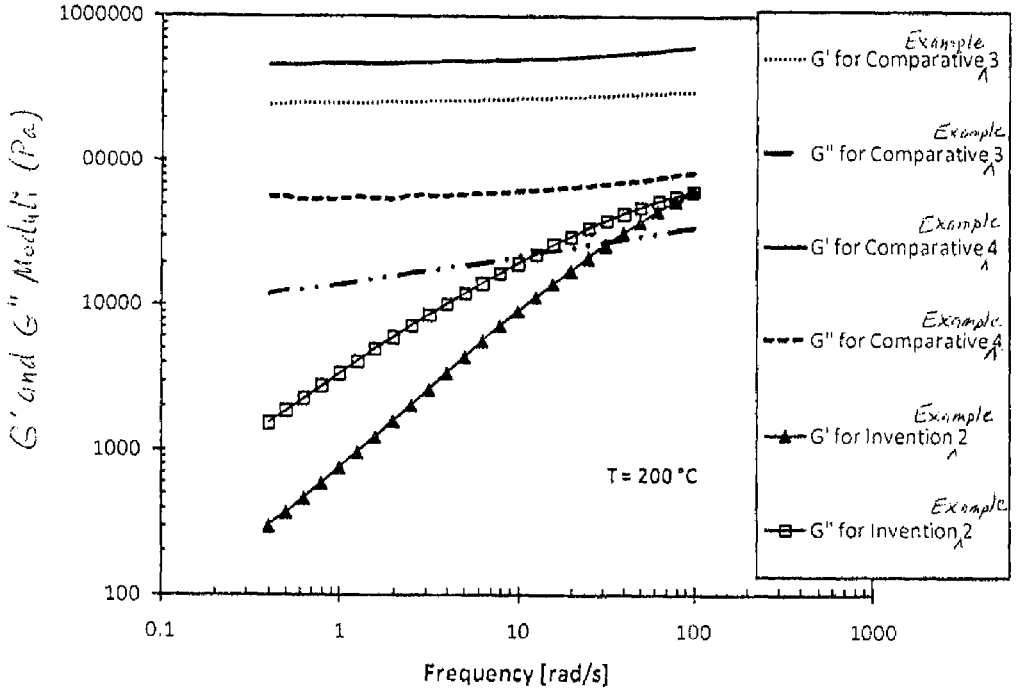
1000000
00000
10000
1000
100
0.1
1
10
100
1000
Frequency [rad/s]
G' and G" Modulus (Pa)
T = 200 °C
Example G' for Comparative 3
Example G" for Comparative 3
Example G' for Comparative 4
Example G" for Comparative 4
Example G' for Invention 2
Example G" for Invention 2

METHOD FOR RECYCLING RELIEF IMAGE ELEMENTS

RELATED APPLICATION

Copending and commonly assigned U.S. Ser. No. 13/053,700 (publication no. 2012/0240802) by Landry-Coltrain and Franklin, and entitled LASER-ENGRAVEABLE FLEXOGRAPHIC PRINTING PRECURSORS.

FIELD OF THE INVENTION

This invention relates to a method that can be used to recycle flexographic relief image compositions. Thus, the method can be used to recycle flexographic printing plate precursors that cannot be used for printing, or to recycle used flexographic printing plates.

BACKGROUND OF THE INVENTION

Flexographic printing plates are sometimes known as "relief printing plates" and are provided with raised relief images onto which ink is applied for application to the printing substance. Flexographic printing plates generally have a rubbery or elastomeric nature. Flexographic printing plates have been imaged in a number of ways. A common method of imaging the plate is to prepare the relief images by exposing photosensitive compositions coated on a substrate through a masking element or transparency and then removing non-exposed regions of the coating with a suitable solvent. The remaining exposed areas are not removed due to the crosslinking of the photosensitive composition that renders these areas insoluble in the wash (or developing) solvents. These remaining areas provide the image areas to be inked and constitute the working part of the flexographic printing plate. Due to the resulting crosslinked nature of the flexographic printing plate, it can no longer be easily re-melted or re-dissolved to produce a new flexographic printing plate precursor. Flexographic printing can also be carried out using a flexographic printing cylinder or seamless sleeve having the desired raised relief image.

The non-printing wells in the relief of a flexographic printing plate are at least 0.05 mm in depth in the screen areas, and can assume values up to 3 mm in other imaged areas in the case of thick flexographic printing plates or other flexographic printing members. Thus, large amounts of material must be removed by means of the laser. Direct laser engraving therefore differs very substantially in this respect from other techniques known from the printing plate sector, in which lasers are used only for imaging thin layers such as for a lithographic printing plate or a mask that is used over a photopolymer flexographic plate, for which the actual production of the flexographic printing plate is still effected by means of a washout and development process.

Various thermoplastic elastomeric materials and olefinic polymers have been described for use as binders in laser-engraveable layers in flexographic printing element precursors. However, such elastomeric layers containing these thermoplastic elastomers generally require thermal or photochemical strengthening by combining the thermoplastic elastomer with chemically reactive species that will form a crosslinked matrix.

Thermally or photochemically crosslinkable layer compositions containing syndiotactic 1,2-polybutadiene that can be used as a flexographic printing plate are described in EP 1,958,968 (Nakamura et al.) and U.S. Pat. No. 7,101,653 (Kaczun et al.). In these compositions, crosslinking is required to provide good properties.

It is generally known that laser-engravable layers should be crosslinked, hardened, or vulcanized in order to prevent the formation of melted edges during laser ablation (imaging). The term "melted edges" refers to material distortions or deformations that form during laser ablation when, at the edge of the engraved elements, the layer melts under the influence of the laser beam but is not, or not completely, decomposed and ejected. This is a result of the Gaussian nature of the spatial heat distribution of the laser and of the finite radius of the laser beam. Such melt edges cannot be removed or at least cannot be completely removed even by subsequent washing and they lead to a blurred print. Undesired melting of the layer furthermore results in reduced resolution of the print motif in comparison with the digital data record.

For example, U.S. Pat. No. 6,776,095 (Telser et al.) describes using a two-step crosslinking process and various thermoplastic elastomer block copolymers to provide laser-engravable flexographic printing plate precursors, and to reduce the occurrence of melted edges during the laser engraving step that would impair the printing performance. To achieve this, the thermoplastic elastomers can be styrene-butadiene and styrene-isoprene block copolymers that are used in combination with suitable crosslinking chemistry.

To prevent the formation of melted edges during laser ablation, U.S. Pat. No. 7,290,487 (Hiller) describes a crosslinkable, laser-engravable layer that comprises a hydrophobic elastomeric binder, a plasticizer, and crosslinking chemistry.

It is also generally known that a laser-ablatable layer can also be cross-linked, hardened, or vulcanized in order to prevent excessive material swelling caused by the inks during printing and by plate cleaning solvents.

However, it is a recognized problem that cross-linked, hardened, or vulcanized materials cannot easily be readily reprocessed, reformed, re-used, or recycled to their original compositions and uses. Thus, the used flexographic printing plates must be discarded, creating a significant environmental problem.

Crosslinking of elastomeric compositions, while useful for the noted reasons, also requires complex material formulations that contain crosslinking or vulcanization chemistry, and cause manufacturing complexities and difficulties, such as premature set-up, incomplete cure, and short composition pot-life (premature crosslinking), especially when relatively thick flexographic printing plate precursors are formed.

Still another problem is encountered when styrene-containing polymers and copolymers are used. These polymers have low solvent resistance and high degrees of swelling in acetate-containing cleaning solvents that are used to clean the ink deposits on flexographic printing plates during printing runs, and in solvent-based flexographic printing inks. The flexographic printing plates swell and deform during printing, resulting in lower printing quality. In addition, solvent swelling of the flexographic printing plate during a printing run compromises its abrasion resistance, durability, and plate lifetime.

Thus, there are several difficult problems to be addressed by skilled artisans in flexography and an approach or composition that solves one or more problems can worsen other problems. There is also a need for recyclable flexographic printing plates that are prepared from various non-crosslinkable compositions that do not suffer from the various problems described above.

SUMMARY OF THE INVENTION

This invention provides a method for recycling comprising:

melting an elastomeric laser-engraved layer of a flexographic printing member, the laser-engravable layer comprising a thermoplastic elastomeric nanocrystalline polyolefin, to form a melt, and reforming the melt into a new laser-engravable flexographic printing precursor for providing a relief image by laser engraving.

In some embodiments, this recycling method further comprises: before the melting, separating the laser-engraved layer from all other layers and substrate of the flexographic printing member.

The laser-engraveable flexographic printing precursors described herein can be readily imaged to provide relief images for flexographic printing. These precursors comprise a relief-forming, laser-engraveable layer that comprises a unique binder that is readily recyclable. This unique binder enables the precursor to be laser-engraved without the formation of imaging defects, such as melt edges. In addition, this unique binder provides physical properties that are critically important for a flexographic printing plate, specifically good elasticity and compression recovery, and low swell in solvents used to clean the plates before and after printing and in solvents commonly used in solvent-based printing ink formulations. The binder providing these advantages is a thermoplastic elastomeric nanocrystalline polyolefin (as defined below). These properties make the flexographic printing precursors and imaged printing members recyclable.

BRIEF DESCRIPTION OF THE DRAWING

FIG. 1 is a graphical representation of G' and G" moduli versus oscillation frequency as described below in the Examples.

DETAILED DESCRIPTION OF THE INVENTION

Definitions

The following definitions identify various terms and phrases used in this disclosure to define the present invention. Unless otherwise noted, these definitions are meant to exclude other definitions of the terms or phrases that may be found in the prior art.

The term "thermoplastic elastomer" or TPE refers to a polymer (homopolymer or copolymer) that exhibits both thermoplastic and elastomeric properties. While most elastomers are thermosets, thermoplastic elastomers exhibit rubber elasticity at ambient temperature and are fluidized by heating and thus are relatively easy to use in manufacturing, for example, by injection molding and extrusion. The principal difference between thermoset elastomers and thermoplastic elastomers is the type of crosslinking bond in their structures. The crosslink in thermoset polymers is a covalent bond created by a chemical reaction. On the other hand, the crosslink in a thermoplastic elastomer is created by a physical association that takes place in one of the phases of the material and is termed a physical crosslink. This physical association can be disrupted, for example, by heating and will reform upon cooling. It is therefore reversible.

The term "chemical crosslinking" refers to the instance when components of a composition are crosslinked by chemical bonds resulting from a chemical reaction. Chemical crosslinks (herein referred to as "crosslinks") are bonds that link one polymer chain to another. Chemical crosslinking involves joining together two or more polymer molecules with chemical or covalent bonds that are strong. Chemical crosslinking results in a rapid increase in molecular weight and a corresponding increase in melt viscosity. These crosslinks promote a difference in the physical properties of the polymeric material. When a polymer is said to be "crosslinked", it usually means that the entire bulk of the polymer has been exposed to a crosslinking method. The resulting modification of mechanical and rheological properties depends strongly on the amount of crosslinking, or the crosslink density. When the degree of crosslinking is low, the crosslinking results in a higher molecular weight, or even a branched structure, of the polymer formed. Low crosslink densities raise the viscosities of polymer melts but do not result in complete cessation of melt flow properties. When the amount of crosslinking is further increased, part of the polymer will form a polymer network, which does not dissolve, but only swells in a solvent. This also leads to the formation of a complete and infinite polymer network, also known as a gel. The "gel point", or critical point of gelation, in polymer chemistry is the point at which an infinite polymer network first appears. The viscosity diverges logarithmically as the critical point (gel/infinite network formation) is approached. In this case, the gel will not flow under the action of a mechanical stress imposed for an infinite period of time. Thus, crosslinked polymers therefore lose their thermoplastic properties and are no longer melt processable. This renders the melt processing equipment, such as extruders, injection molding devices, and calendering devices, unsuitable for processing these materials.

Chemical crosslinks can be formed by chemical reactions that are initiated by heat, pressure, change in pH, or radiation. For example, mixing an unpolymerized or partially polymerized resin that contains reactive functionality with specific chemicals called crosslinking reagents results in a chemical reaction that forms crosslinks. Crosslinking can also be induced in materials that are normally thermoplastic through exposure to a radiation source, such as an electron beam, gamma-radiation, or UV light. The crosslinking reaction can be thermally induced, for example as in the formation of thermosetting elastomers, such as urethanes or epoxy resin, or in the reaction of compounds containing multiple ethylenically unsaturated groups, such as acrylates, or in the vulcanization of rubbers using either sulfur-containing or peroxide curing agents, or it can be photochemically induced, for example as in the reaction of acrylates containing multiple ethylenically unsaturated groups, or by the way of free-radical initiated reactions. The chemical process of vulcanization is a type of crosslinking and it changes the property of rubber. This process is often called sulfur curing but can also be accomplished using peroxides. Crosslinks are the characteristic property of a thermoset material. Chemical covalent crosslinks are stable mechanically and thermally so once formed, chemical covalent crosslinks are difficult to break. In general, chemical crosslinking is irreversible, and the resulting thermosetting material will degrade or burn if heated, without melting. Once a polymeric substance is chemically crosslinked, the product is very difficult or impossible to melt and recycle. Specific chemical treatments and procedures are necessary to recover the starting materials.

Chemical crosslinking often requires the use of a crosslinking agent, such as a catalyst, a free-radical or acid-generating initiator, a photoinitiator, or combinations of these. A crosslinking agent is a substance that promotes or regulates intermolecular covalent bonding between polymer chains, linking them together to create a more rigid structure. Thus, in general, a precursor composition that is free of chemical crosslinking agents in combination with species that can be crosslinked will result in a plate that is free of chemical crosslinking. Furthermore, a precursor composition that is free of chemical crosslinking agents will not be photosensitive so as to be susceptible to photochemical crosslinking.

It is possible, however, that a laser-engravable flexographic printing precursor does contain chemical crosslinks that resulted from the reaction of chemical crosslinking agents but that these chemical crosslinking agents are totally consumed during the chemical reactions prior to the preparation of the precursor, wherein these crosslinks do not hinder the melt flow properties of the material. In some such cases, crosslinking may be directed only to isolated, non-continuous or non-connected areas within the material, wherein the bulk of the material or continuous phase of the material remains un-crosslinked. In another example, inclusions, such as particles or beads that have been previously crosslinked, are added to a non-crosslinked material. These particles or beads can be of organic or inorganic materials. In these cases, as long as these pre-crosslinked inclusions do not further react with the continuous phase of the material, the bulk viscosity will not be increase to infinity and the material will remain melt processable.

The existence of gel-like structure in a material can be measured by rheology and viscoelasticity. The behavior of un-crosslinked rubbery polymers in processing machinery such as mixers, mills, calenders, extruders, and blow molding equipment is closely related to viscoelastic properties of the material that govern melt-flow behavior. ["Viscoelastic Properties of Polymers", 3rd Edition, by J. D. Ferry; John Wiley & Sons, Inc., NY, 1980.] The changes in physical properties on crosslinking can be monitored by measuring viscoelastic behavior under cyclical small deformations at a frequency of oscillation such as is measured with the use of a mechanical spectrometer. The method used for determining viscoelastic properties of the subject resins involves subjecting a disk-shaped sample to very small deformation (less than 1% strain) in a cyclic fashion at a frequency of oscillation using an instrument such as a Rheometrics Mechanical Spectrometer equipped with oscillating parallel plates. During deformation of the sample, a certain amount of energy is lost due to molecular segmental motions. The remaining energy is stored by elastic mechanism. The two types of behavior are simultaneously measured during testing and are reflected in the magnitudes of the loss modulus (G") and storage or elastic modulus (G'). Frequency sweeps are used to investigate the time-dependent shear behavior of these viscoelastic properties and are oscillatory tests performed at variable frequencies, keeping the amplitude and temperature at a constant value. The measurement should be performed above the melting point of any crystalline region or "association/de-association temperature" of any "physical crosslinks". Frequency sweeps can be used to differentiate clearly between crosslinked and un-crosslinked materials, as described in Chapter 8 of "The Rheology Handbook", 2nd Edition, by Thomas G. Mezger, publisher: Vincentz Network GmbH & Co., Hannover, Germany, 2006. For non-crosslinked polymers, the G' and G" moduli, when plotted logarithmically, decrease continuously as the frequency of oscillation is decreased (in the low frequency, or terminal zone). Thus these non-crosslinked materials exhibit melt flow behavior. For crosslinked polymers, the G' modulus curve and G" modulus curve approach a nearly constant, frequency independent, limiting value with a slope approaching zero. Crosslinked polymers do not exhibit melt flow behavior.

The term "physical crosslinking" refers to thermoplastic elastomers (TPE) that have physical crosslinks forming a physical network structure in the polymer microstructure to achieve stability. With respect to the molecular structure, the TPE comprises a soft segment phase that has a glass transition temperature lower than the use temperature and a hard segment that prevents plastic deformation around ambient or use temperature. Examples of the hard segment include, but are not limited to, a phase that has a glass transition temperature higher than the use temperature, a crystalline phase, a hydrogen bond, or an ionic phase. The hard phase provides physical crosslinking or a physical network structure that is generally reversible, so they can be formed and reformed, for example, by heat processing control. The "association/de-association temperature" is the temperature at which the material changes from having a physical crosslinked or network structure to material that flows and behaves as a non-crosslinked material as described above.

The term "melt processable" in the context of a thermoplastic elastomer refers to a material that can exhibit melt flow behavior, as defined above, at temperatures above the melting temperature or the association/de-association temperature. Thus, a material that is chemically crosslinked as defined above will not be melt processable.

The term "nanocrystalline" refers to a material having a crystalline grain size in the nanometer range (less than one micrometer) in diameter. Typically, a semi-crystalline polymer will have a morphology in which the domains are dispersed in a "sea-island" state wherein an amorphous area is a "sea" and a crystal area is an "island". In the case of a nanocrystalline polyolefin, the morphological structure is that in which "islands" that have a crystalline volume with a diameter of less than 1 μm and typically from 10 nm (nanometers) to 400 nm and these communicate with each other to form a network structure, thereby uniformly spanning the entire amorphous area. This can be accomplished, for example but not exclusively, by synthesizing a blocky copolymer wherein the adjacent blocks have different tacticity (such as isotactic versus atactic) and thus have different crystallization behaviors. Thus, for example, islands of isotactic blocks that would be crystalline are connected via amorphous segments of atactic blocks of the same monomeric species. Alternatively, blocks derived from different monomeric species can be constructed wherein one monomeric species will form a crystalline phase and the other species will form the amorphous phase. Because of this physical network structure, the nanocrystalline polyolefin used in this invention has excellent durability, heat resistance, and flexibility. Whereas elastomers outside of this invention have a crystalline grain size on the order of a micrometer or larger, the thermoplastic elastomer used in the practice of this invention has a controlled crystalline grain size as noted above to provide a combination of elasticity needed for a flexographic printing member, and a high heat distortion temperature that is important for laser-engraveability. The TPE's of this invention have both nanocrystalline regions and amorphous regions and this provides the elasticity and compression recovery needed for a flexographic printing plate.

The size of the crystalline domain, or crystalline region, or crystalline grain size should not be confused with the crystallite size. A crystalline domain or region is comprised of many crystallites, which are typically on the order of 50-250 Ångstroms in size, regardless of the domain size. The size of the crystallites is typically measured by X-ray diffraction. The size of the crystalline domain or region can be determined at high magnification by methods known in the art such as Transmission Electron Microscopy.

In practice, one can determine if a non-oriented crystalline material has a nanocrystalline structure in contrast to a crystalline structure where the crystalline grain size is larger than approximately the wavelength of visible light by placing a thin film of the material between two polarizers that are rotated at a ninety degree angle with respect to each other, that is, through crossed polarizers, and viewing the light transmitted using a microscope. When unpolarized light is transmitted through a plane polarizer (polarizer lens), it becomes plane polarized in one direction. If the planarized light is then passed through another plane polarizer, oriented at 90 degrees to the first one, no light will be transmitted.

Polarized light interacts with anisotropic materials. This is usually seen in crystalline materials. Since the refractive index is different for horizontally and vertically polarized light in these materials, the polarizability of anisotropic materials is not equivalent in all directions. This anisotropy causes changes in the polarization of the incident beam, and is easily observable using cross-polar microscopy or polarimetry. In such cases, light will be transmitted when an anisotropic or crystalline material is placed between polarizers that are oriented at 90 degrees to each other. Isotropic materials, such an unoriented amorphous polymer, do not interact with polarized light and therefore, light will not be transmitted when this material is placed between polarizers that are oriented at 90 degrees to each other.

Nanocrystalline domains or regions that are smaller than the wavelength of visible light and that are randomly oriented will not transmit unpolarized visible light through the assembly of crossed polarizers. As the size of the crystalline domains becomes large enough, and is considered "non-nanocrystalline", meaning outside of the definition stated herein of "nanocrystalline", light will be transmitted through the crossed polarizer assembly.

The term "flexographic printing precursor" refers to an article or element used in the practice of this invention that can be used to prepare a flexographic printing member and can be in the form of flexographic printing plate precursors, flexographic printing cylinder precursors, or flexographic printing sleeve precursors.

The term "flexographic printing member" refers to articles useful in the practice of the present invention that are imaged flexographic printing precursors and can be in the form of a printing plate having a substantially planar elastomeric outermost surface, or a printing cylinder or seamless printing sleeve having a curved elastomeric topmost surface. The flexographic printing member has a relief image in the outermost surface (that is, the laser-engraved layer).

The term "patternable material" refers that include but are not limited to, flexographic printing precursors, mask elements, photoresists, patterned dielectrics, patterned 3-dimensional structures, patterned barrier films, patterned molds including those for embossing and nanoimprinting applications, patterned microfluidic devices or structures, and lithographic plates or precursors. Such articles can be provided in any form, shape, or size, with or without a substrate, but having at least a thermoplastic elastomeric nanocrystalline polyolefin and a radiation absorber, typically in a laser-engraveable layer.

The term "receiver element" refers to any material or substrate that can be printed with ink using a flexographic printing member.

The term "laser imaging" refers to laser engraving, 'imaging' refers to the ablation of the background areas leaving intact the areas of the plate which will be inked up and printed by flexography.

The term "laser-engraveable" relates to a composition or layer that can be imaged using a suitable laser that produces heat within the composition or layer that causes rapid local changes in the composition or layer so that the imaged regions are physically detached and ejected from the rest of the composition or layer and appropriately collected. The breakdown is a violent process that includes eruptions, explosions, tearing, decomposition, volatilization, fragmentation, or other destructive processes that create a broad collection of materials including one or more gases. This is distinguishable from, for example, image transfer. Imaging or relief image formation is achieved using "laser engraving" that can also be known as "ablation engraving" or "ablative engraving". Non-imaged regions of the laser-engraveable layer are not removed or volatilized to an appreciable extent and thus form the upper surface of the relief image.

The "elastomeric, relief-forming, laser-engraveable layer" refers to the outermost surface of the flexographic printing precursor in which a relief image is formed and is the first surface of the precursor that is struck by imaging radiation. This layer is also referred to herein as the "laser-engraveable layer".

The term "relief image" refers to all of the topographical features of the flexographic printing member provided by imaging and designed to transfer a pattern of ink to a receiver element. The term "relief image floor" refers to the bottom-most surface of the relief image. For example, the floor can be considered the maximum dry depth of the relief image from the topmost surface and can range from 50 μm to 1000 μm and typically from 100 μm to 800 μm. The relief image generally includes "valleys" that are not inked and that have a depth from the topmost surface that is less than the maximum floor depth.

Unless otherwise indicated, the term "weight %" refers to the amount of a component or material based on the total dry weight of the composition or layer in which it is located.

The term "binder" refers to the sum of all thermoplastic and thermoplastic elastomeric polymeric components within the laser-engravable layer, including the thermoplastic elastomeric nanocrystalline polyolefin.

Laser-Engraveable Layer

The relief image is formed in the laser-engraveable layer that comprises as its primary or predominant component, one or more thermoplastic elastomeric nanocrystalline polyolefins. Thus, the laser-engraveable layer comprises the thermoplastic elastomeric nanocrystalline polyolefin in an amount of at least 30 weight % and up to and including 100 weight %, or typically at least 50 weight % and up to and including 98 weight %, based on total dry layer weight.

In general, the laser-engraveable layer has a dry thickness of at least 50 μm and generally at least 50 μm and up to and including 4,000 μm, or at least 200 μm and up to and including 2,000 μm.

The laser-engraveable layer is essentially free of polymers containing pendant aromatic groups (such as styrene and substituted styrene groups). That is, no polymers containing pendant styrenic groups are purposely added to the laser-engraveable layer. Such polymers include polystyrenes (including homopolymers of styrene derivatives), poly(methylstyrenes), copolymers and block copolymers derived at least in part by the polymerization of vinyl benzene (styrene) and styrene derivatives, vinyl aromatic or vinyl aromatic hydrocarbons or alkenylaromatic polymers. Thus, such polymers are generally present in the laser-engraveable layer in an amount of less than 5 weight %, and typically, the amount is less than 1 weight %, based on total dry layer weight.

In addition, the laser-engraveable layer is also free of chemical crosslinking as defined above. It is understood that chemical crosslinking can be achieved by several methods, such as by exposure to a radiation source, such as electron beams, gamma radiation, or UV light, or by the addition of chemical crosslinking agents or reagents into the composition. It is understood that no chemical crosslinking agents are purposely added to the laser-engraveable layer of the precursor. Such chemical crosslinking agents are well known in the art and include for example, peroxides, sulfur and sulfur-containing compounds, photoinitiators, and other free radical generating compounds. In addition, such chemical crosslinking agents can be acid-generating compounds. Thus, the laser-engraveable layer or precursor generally contains no chemistry that would generate free radicals or acid radicals that would lead to crosslinking. Such chemical crosslinking agents are thus generally present in the laser-engraveable layer in an amount of less than 0.5 weight %, and typically, the amount less than 0.1 weight %, based on total dry layer weight.

The reason that the laser-engraveable layer is generally free of chemical crosslinking is so that the layer retains significantly all of the thermoplasticity that enables it to exhibit good melt flow properties so that it can be melted and reformed into a new flexographic printing precursor as described above.

The thermoplastic elastomeric nanocrystalline polyolefin used in the laser-engraveable layer generally has a glass transition temperature less than or equal to 10° C. and typically less than or equal to 0° C., as measured using known procedures including differential scanning calorimetry (DSC), dynamic mechanical analysis (DMA, DMTA), or thermal mechanical analysis (TMA).

The thermoplastic elastomeric nanocrystalline polyolefin used in the laser-engraveable layer generally has a crystalline melting temperature greater than or equal to 40° C. and preferably greater than or equal to 100° C., as measured using known procedures including differential scanning calorimetry (DSC).

In another aspect, the elastomeric relief-forming, laser-engraveable layer containing the thermoplastic elastomeric nanocrystalline polyolefin, has G' and G" values that decrease continuously with a decrease in the frequency of oscillation when plotted logarithmically, at a temperature above the melting temperature of the laser-engraveable layer.

Useful nanocrystalline polyolefins include but are not limited to homopolymers of ethylenically unsaturated olefin hydrocarbons having 2 to 20 carbon atoms and typically from 2 to 8 carbon atoms. Such unsaturated α-olefins having at least 3 carbon atoms can have various linear or branched alkyl side chains, and any of the olefins can have other side chains provided that the side chains do not adversely affect the polyolefin morphology or thermoplastic and elastomeric properties. Nanocrystalline polymers also include copolymers that comprise at least two different randomly ordered olefin recurring units. For example, these copolymers can include randomly recurring units derived (polymerized) from two or more different olefins having at least 2 and up to 20 carbon atoms, for example, a combination of recurring ethylene, propylene, butylenes, octene, and norbornene recurring units, in a random order in the polymer backbone. In such copolymers, one type of olefin recurring unit can predominate. For example, propylene recurring units can comprise at least 50 mol % and up to and including 90 mol % of the total recurring units of the nanocrystalline polyolefin. The useful copolymers can have their different recurring units arranged in an alternating, a random, or a periodic sequence. In addition, these copolymers can be linear copolymers, block copolymers, tapered copolymers, block terpolymers, multiblock copolymers, graft copolymers, branched copolymers, including star, brush, comb, and dendritic copolymers. Other specific examples of the α-olefins useful for preparing copolymers include but are not limited to, ethylene, 1-propene, 1-butene, 1-pentene, 1-hexene, 1-heptene, 4-methyl-1-pentene, 1-octene, 1-nonene, 1-decene, 1-undecene, 1-dodecene, 1-tridecene, 1-tetradecene, 1-pentadecene, 1-hexadecene, 1-heptadecene, 1-octadecene, 1-nonadecene, 1-eicocene, 9-methyl-1-decene, 11-methyl-1-dodecene, and 12-ethyl-1-tetradecene.

The copolymers can also include up to 20 mol % of total recurring units that are derived from non-conjugated polyenes include dicyclopentadiene, 1,4-hexadiene, cyclooctadiene, methylene norbornene, ethylidene norbornene, vinyl norbornene, 4-methyl-1,4-hexadiene, 5-methyl-1,4-hexadiene, 4-ethyl-1,4-hexadiene, 5-methyl-1,4-heptadiene, 5-ethyl-1,4-heptadiene, 5-methyl-1,5-heptadiene, 6-methyl-1,5-heptadiene, 5-ethyl-1,5-heptadiene, 4-methyl-1,4-octadiene, 5-methyl-1,4-octadiene, 4-ethyl-1,4-octadiene, 5-ethyl-1,4-octadiene, 5-methyl-1,5-octadiene, 6-methyl-1,5-octadiene, 5-ethyl-1,5-octadiene, 6-ethyl-1,5-octadiene, 6-methyl-1,6-octadiene, 7-methyl-1,6-octadiene, 6-ethyl-1,6-octadiene, 4-methyl-1,4-nonadiene, 5-methyl-1,4-nonadiene, 4-ethyl-1,4-nonadiene, 5-ethyl-1,4-nonadiene, 5-methyl-1,5-nonadiene, 6-methyl-1,5-nonadiene, 5-ethyl-1,5-nonadiene, 6-ethyl-1,5-nonadiene, 6-methyl-1,6-nonadiene, 7-methyl-1,6-nonadiene, 6-ethyl-1,6-nonadiene, 7-ethyl-1,6-nonadiene, 7-methyl-1,7-nonadiene, 8-methyl-1,7-nonadiene, 7-ethyl-1,7-nonadiene, 5-methyl-1,4-decadiene, 5-ethyl-1,4-decadiene, 5-methyl-1,5-decadiene, 6-methyl-1,5-decadiene, 5-ethyl-1,5-decadiene, 6-ethyl-1,5-decadiene, 6-methyl-1,6-decadiene, 7-methyl-1,6-decadiene, 6-ethyl-1,6-decadiene, 7-ethyl-1,6-decadiene, 7-methyl-1,7-decadiene, 8-methyl-1,7-decadiene, 7-ethyl-1,7-decadiene, 8-ethyl-1,7-decadiene, 8-methyl-1,8-decadiene, 9-methyl-1,8-decadiene, 8-ethyl-1,8-decadiene, 9-methyl-1,8-undecadiene and the like. Examples of useful nanocrystalline homopolymers include but are not limited to, polyethylene, polypropylene, poly(1-butylene), poly(1-pentylene), poly(1-hexylene), poly(1-octylene), poly(1-decylene), poly(2-butene), poly-4-methyl-1-pentene, poly(vinyl cyclohexane), and other cyclo olefin polymers. Examples of useful nanocrystalline copolymers include but are not limited to, copolymers comprising at least propylene recurring units, copolymers comprising both propylene and ethylene recurring units, copolymers comprising both ethylene and butene recurring units, copolymers comprising both ethylene and octene recurring units, and copolymers comprising ethylene, propylene, and butene recurring units. The configuration of the repeating units can have any tacticity, including, atactic, isotactic, or syndiotactic.

Also useful is the introduction of minor amounts of functional groups, such as polar groups for example >CO, —OH, and —COOH, by copolymerization into the nanocrystalline polyolefin for the purpose of increasing its adhesive properties, to, for example, a substrate, or for the purpose of improving the compatibility of the nanocrystalline polyolefin with additives such as plasticizers and particulates such as radiation absorbers, inorganic oxides, and microcapsules. Other useful copolymer compositions can be copolymers of the α-olefin having from 2-20 carbon atoms and a vinyl ester such as vinyl acetate or vinyl propionate, or an alkyl ester having up to 20 carbon atoms or an unsaturated carboxylic acid such as acrylic acid, methacrylic acid, maleic acid, maleic anhydride, fumaric acid, itaconic acid, or itaconic anhydride or an acrylate or methacrylate such as methyl acrylate, ethyl acrylate, isopropyl acrylate, n-propyl acrylate, isobutyl acrylate, n-butyl acrylate, 2-ethylhexyl acrylate, methyl methacrylate, ethyl methacrylate, isobutyl methacrylate, n-butyl methacrylate, glycidyl methacrylate, dimethyl maleate, or diethyl maleate, as long as the inclusion of these co-monomers does not adversely affect the polyolefin morphology or elastomeric and performance properties of the material.

A commercial form of an example nanocrystalline polyolefin is available as a NOTIO PN-2070 elastomer from Mitsui Chemicals, Inc. (Tokyo). This commercial product is a predominantly propylene elastomer that has a nanocrystalline structure controlled by leveraging the characteristics of metallocene catalysts used to make the polymer. This elastomer has propylene-derived constitutional units at 71 mol % and the remaining recurring units derived from ethylene and a 1-butene. This thermoplastic elastomer has physical properties of a Shore A hardness (ASTM D2240) of 75, a melting point of 138° C., a density (ASTM D1505) of 867 kg/m$^3$, a glass transition temperature (Tg) of −29° C., a haze of 7%, and a melt flow rate (MFR, ASTM D1238) of 7.0 g/10 min. Other useful commercial examples of nanocrystalline polyolefins are found as the NOTIO products from Mitsui Chemicals America, Inc., Rye Brook, NY., and as the ENGAGE products from Dow Chemical.

Still other useful nanocrystalline polyolefins can be prepared using known synthetic procedures as described, but not limited to, for example in U.S. Pat. Nos. 6,930,152 (Hashimoto et al.) and 7,253,234 (Mori et al.), and U.S. Patent Application Publication 2008-0220193 (Tohi).

The laser-engraveable layer can have a mixture of polymers in which the nanocrystalline polyolefin comprises at least 30 weight % and up to and including 99 weight %, and typically at least 50 weight % and up to and including 97 weight %, based on dry layer weight. Such mixtures can include non-nanocrystalline polymers including non-nanocrystalline polyolefins. Thus, in some embodiments, the laser-engraveable layer can comprise a mixture of one or more thermoplastic elastomeric nanocrystalline polyolefins and one or more non-nanocrystalline polyolefins. This non-nanocrystalline polymer can also be a thermoplastic elastomer, a semi-crystalline polymer, or it can be a thermoplastic non-elastomeric resin, which can be present in an amount such that it does not adversely affect the laser-engraveability, recyclability, and physical properties that are desired using the present invention. For example, such mixtures can comprise a thermoplastic elastomeric nanocrystalline polypropylene (at least 50 weight % and up to and including 99 weight %) and a non-nanocrystalline semi-crystalline polypropylene. Other non-nanocrystalline polymers can be present as long as the styrene-containing polymers are not purposely included in the laser-engraveable layer. In some embodiments, the laser-engraveable layer can comprise a mixture of a thermoplastic elastomeric nanocrystalline polyolefin and another thermoplastic elastomeric nanocrystalline polyolefin. In some embodiments, the thermoplastic elastomeric nanocrystalline polyolefin or the non-nanocrystalline polyolefin can either or both have a branched structure.

For example, the laser-engraveable layer can include one or more thermoplastic polymers such as urethane resins that are derived from the reaction of a polyisocyanate with a polyol (such as polymeric diol) or with a polyamine. Other useful polymers include polyisocyanate, polybutadiene or polyisoprene elastomers, nitrile polymers, polychloroprene, polyisobutylene, and other butyl elastomers, any elastomers containing chlorosulfonated polyethylene, polysulfide, polyalkylene oxides, or polyphosphazenes, polymers of (meth) acrylates, polyesters, and other similar polymers known in the art. Although it can be desirable that these non-nanocrystalline polymers have elastomeric properties, it is not strictly necessary as long as their presence does not adversely affect the laser-engraveability, recyclability, and physical properties that are desired for the present invention. In some embodiments, the thermoplastic elastomeric nanocrystalline polyolefin or the non-nanocrystalline polymer can have a branched structure.

Mixtures of different types of nanocrystalline polyolefins are useful in the laser-engraveable layer. It is important to consider the miscibility and compatibility of the component polymers when making mixtures, as these will affect the physical properties and performance of the final material.

For infrared imaging using laser diodes whose peak energy output is in the near infrared, the material must contain a special radiation absorber species in the form of a dye or pigment that absorbs the laser energy and converts exposing photons into thermal energy. Since most polymeric materials do not absorb radiation directly at a wavelength of at least 750 nm and up to and including 1400 nm, flexographic printing precursors prepared to be engraved using laser irradiation at these wavelengths can also contain at least one IR absorber. Such IR absorbers can be dyes with a specific absorption peak or a pigment such as carbon black where absorption is panchromatic over the entire near infrared spectrum.

The laser-engraveable layer can further comprise a radiation absorber in an amount of at least 0.5 weight % and up to and including 35 weight %, and particularly at least 3 weight % and up to and including 15 weight %, based on total dry layer weight.

Particularly useful infrared radiation absorbers are responsive to exposure from IR lasers. Mixtures of the same or different types of infrared radiation absorbers, as described below, can be used if desired. A wide range of infrared radiation absorbers are useful in the present invention, including carbon blacks and other IR-absorbing organic or inorganic pigments (including squarylium, cyanine, merocyanine, indolizine, pyrylium, metal phthalocyanines, and metal dithiolene pigments) and iron and other metal oxides. Additional useful IR radiation absorbers include conductive carbon blacks and carbon blacks that are surface-functionalized with solubilizing or compatibilizing groups that are well known in the art. Carbon blacks that are grafted to hydrophilic, nonionic polymers, such as FX-GE-003 (manufactured by Nippon Shokubai), or which are surface-functionalized with anionic groups, such as CAB-O-JET® 200 or CAB-β-JET° 300 (manufactured by the Cabot Corporation) are also useful. Examples of useful carbon blacks include Mogul® L, Mogul® E, Emperor® 2000, Vulcan® XC-72, Sterling C, Black Pearls® 700 and 1300, Monarch® 800 and 1400, and Regal®330, and 400, all from Cabot Corporation (Boston Mass.). Other useful pigments include, but are not limited to, Heliogen Green, Nigrosine Base, iron (III) oxides, transparent iron oxides, magnetic pigments, manganese oxide, Prussian Blue, and Paris Blue. Other useful IR radiation absorbers are carbon nanotubes such as single- and multi-walled carbon nanotubes, graphite, graphene, and porous graphite. Graphene is an atomically thick, two-dimensional sheet composed of carbon atoms arranged in a honeycomb structure. It can be viewed as the building block of all other graphitic carbon allotropes of different dimensionality, for example, graphite is made of graphene sheets stacked on top of each other. Examples of useful graphenes include, but are not limited to, xGnP graphene nanoplatelets from XG Sciences, MI, including Grade M particles that have an average thickness of approximately 6-8 nm and a typical surface area of 120 to 150 m$^2$/g, and Vor-X functionalized graphene nanosheets from Vorbec Materials, MD, and graphene from Graphene Industries, UK and Graphene Laboratories, MA.

Other useful infrared radiation absorbers (such as organic dyes having a $\lambda_4$, of at least 800 inn) are described in U.S. Pat. Nos. 4,912,083 (Chapman et al.), 4,942,141 (DeBoer et al.), 4,948,776 (Evans et al.), 4,948,777 (Evans et al.), 4,948,778 (DeBoer), 4,950,639 (DeBoer et al.), 4,950,640 (Evans et al.), 4,952,552 (Chapman et al.), 4,973,572 (DeBoer), 5,036,040 (Chapman et al.), and 5,166,024 (Bugner et al.), all of which are incorporated herein by reference.

When pigments or particulate IR absorbers are used, it should be recognized that a finer dispersion of very small particles will provide an optimum ablation feature resolution and ablation sensitivity. Particularly suitable are those with diameters less than 1 μm. Dispersants and surface functional ligands can be used to improve the quality of the carbon black or metal oxide, or pigment dispersion so that uniform incorporation of the IR radiation absorbing compound throughout the laser-ablatable, relief-forming layer can be achieved.

The laser-engraveable flexographic printing precursors or other patternable materials include the one or more thermoplastic elastomeric nanocrystalline polyolefins and a radiation absorber (such as an infrared radiation absorber) in the same laser-engraveable layer. In such embodiments, the one or more nanocrystalline polyolefins are present in a total amount of at least 30 and up to and including 98 weight %. The radiation absorber can be present in an amount of at least 2 weight % and up to and including 35 weight %, and typically of at least 3 weight % and up to and including 20 weight %, based on the total dry weight of the layer.

The laser-engraveable layer can further comprise chemically inactive particles or microcapsules in an amount of at least 2 weight % and up to and including 50 weight %, or typically at least 5 weight % and up to and including 25 weight %, based on total dry layer weight. The term "inactive" means that the particles or microcapsules are chemically inert and do not chemically react with the polymeric binders or radiation absorbers. In addition, these inactive particles or microcapsules do not contain radiation absorbers and do not absorb the laser radiation. However, their presence can reinforce the mechanical properties of the material, increase the hardness of the material, or decrease the tackiness of the material and ablation debris, enabling easier debris collection and improving the cleanliness of the laser-engraved member.

Inactive inorganic particles include various inorganic filler materials including but not limited to, silica, titanium dioxide, and alumina, and particles such as fine particulate silica, fumed silica, porous silica, barium sulfate, calcium carbonate, calcium sulfate, zinc oxide, mica, talc (magnesium silicate hydrate), surface treated silica (sold as Aerosil from Degussa and Cab-O—Sil from Cabot Corporation), zeolites, and silicate minerals and clays such as bentonite, montmorillonite, and kaolinite, aluminum silicates, halloysite and hallosite nanotubes, and micropowders such as amorphous magnesium silicate cosmetic microspheres sold by Cabot and 3M Corporation.

In some embodiments, inactive microcapsules can be dispersed within the laser-engraveable layer, for example, within the thermoplastic elastomeric nanocrystalline polyolefins. The inactive microcapsules can also be known as "hollow beads", "microspheres", "microbubbles", or "micro-balloons". Such components can include hollow glass beads or beads with a thermoplastic polymeric outer shell and either core of air or a volatile liquid such as isopentane and isobutane. For example, inactive microcapsules can be designed like those described in U.S. Pat. Nos. 4,060,032 (Evans) and 6,989,220 (Kanga), or as plastic micro-balloons as described for example in U.S. Pat. Nos. 6,090,529 (Gelbart) and 6,159,659 (Gelbart).

Inactive microspheres can be hollow or filled with an inactive solvent, and facilitate engraving in the laser-engraveable layer because they reduce the energy needed for engraving. Inactive microspheres are generally formed of an inorganic glass material such as silicon oxide glass, a magnesium silicate glass, or an inactive thermoplastic polymeric shell material such as a styrene or acrylate copolymer or a vinylidene chloride copolymer.

Inactive, non-porous polymeric particles can also be incorporated into the laser-engraveable layer in amounts described above for the other types of particles.

Optional addenda in the laser-engraveable layer can also include but are not limited to, plasticizers, colorants such as dyes and pigments, antioxidants, antiozonants, stabilizing compounds, dispersing aids, surfactants, and adhesion promoters, as long as they do not interfere with laser-engraving efficiency, or that the inclusion of these do not adversely affect the polyolefin morphology or elastomeric properties of the material or its recycle-ability. Examples of plasticizers can include low molecular weight polyolefins, polyesters, or polyacrylates, fluorinated compounds, silicone compounds, un-crosslinked liquid rubbers and oils, liquid ethylene-propylene, liquid polybutene, liquid polypropylene, or mixtures of these.

Laser-Engraveable Flexographic Printing Precursors

The laser-engraveable layer can be formed from a formulation comprising one or more elastomeric resins including at least one thermoplastic elastomeric nanocrystalline polyolefin, and optionally a radiation absorber and other additives, and optionally one or more coating solvents, to provide an elastomeric composition. This formulation can be formed as a self-supporting layer or disposed on a suitable substrate (described below). Such layers can be formed in any suitable fashion, for example by coating, flowing, spraying, or pouring a series of formulations onto the substrate by methods known in the art and drying to form a layer, flat or curved sheet, or seamless printing sleeve. Alternatively, the formulations can be press-molded, injection-molded, melt extruded, co-extruded, or melt calendered into an appropriate layer or ring (sleeve) and optionally adhered or laminated to a substrate and cooled to form a layer, flat or curved sheet, or seamless printing sleeve. The flexographic printing precursors in sheet-form can be wrapped around a printing cylinder and optionally fused at the edges to form a seamless printing precursor.

The laser-engraveable flexographic printing precursors can include a self-supporting laser-engraveable layer (defined above) comprising the nanocrystalline polyolefin and other additives. This type of laser-engraveable layer does not need a separate substrate to have physical integrity and strength. In such embodiments, the laser-engraveable layer is thick enough and laser engraving is controlled in such a manner that the relief image depth is less than the entire thickness, for example up to 80% of the entire thickness of the layer.

The total dry thickness of the flexographic printing plate precursors is at least 500 μm and up to and including 6,000 μm or typically at least 1,000 μm and up to and including 3,000 μm. As noted above, all of this thickness can be composed of the laser-engraveable layer, but when a substrate or other layers are present, the laser-engraveable layer dry thickness is typically at least 10% and up to and including 95% of the total dry precursor thickness. Flexographic printing sleeve precursors can generally have a laser-engraveable layer of at least 2 mm and up to and including 20 mm. Flexographic printing cylinders would also have a suitable laser-engraveable layer thickness.

Multiple layers of the laser-engraveable layer (described above) can be disposed one on top of the other in order to create a thicker laser-engravable layer. These layers can be identical, or can differ in composition in that they contain differing amounts and types of additives (for example particulates, microcapsules, radiation absorbers, polymers) relative to the amount of the nanocrystalline polyolefin. Different nanocrystalline polyolefins or combinations thereof can also be used in the different layers. For example, a layer containing hollow microspheres or microbubbles can be disposed under the uppermost laser-engravable layer that does not contain hollow microspheres.

However, in other embodiments, the laser-engraveable flexographic printing precursors include a suitable dimensionally stable, non-laser-engraveable substrate having an imaging side and a non-imaging side. The substrate has at least one laser-engraveable layer (described above) disposed over the substrate on the imaging side. In most embodiments, the laser-engraveable layer is disposed directly on the substrate. Suitable substrates include but are not limited to, dimensionally stable polymeric films, aluminum sheets or cylinders, fiberglass forms, transparent forms, ceramics, woven and non-woven fabrics, or laminates of polymeric films (from condensation or addition polymers) and metal sheets such as a laminate of a polyester and aluminum sheet or polyester/polyamide laminates, a laminate of a polyester film and a compliant or adhesive support, or a laminate of a polyester and a woven or non-woven fabric. A polyester, polycarbonate, vinyl polymer, or polystyrene film can be used. Useful polyesters include but are not limited to poly(ethylene terephthalate) and poly(ethylene naphthalate). The substrates can have any suitable thickness, but generally they are at least 0.01 mm or at least 0.05 mm and up to and including 0.3 mm thick (dry thickness), especially for the polymeric substrates. An adhesive layer can be used to secure the elastomeric composition to the substrate. A thin conductive layer or film of, for example, poly(3,4-ethylenedioxythiophene) (PEDOT), polyacetylene, polyaniline, polypyrrole, or polythiophenes, indium tin oxide (ITO), and graphene, can be disposed between the substrate and the laser engravable layer.

There can be a non-laser-engraveable backcoat on the non-imaging side of the substrate that can be composed of a soft rubber or foam, or other compliant layer. This backcoat can be present to provide adhesion between the substrate and the printing press rollers and to provide extra compliance to the resulting printing member, or to reduce or control the curl of the printing member. In addition, this backcoat can be reflective of imaging radiation or transparent to it. If desired, the backcoat can also be laser-engravable, either by the same type of laser that is used to engrave the imaging side, or by a different type of laser. This backside laser engraving can be useful to record, for example, specific information or metadata.

Thus, the laser-engraveable flexographic printing precursor contains one or more layers but the simpler the precursor, the easier it will be to recycle the resulting flexographic printing member. Besides the laser-engraveable layer, there can be a non-laser-engraveable elastomeric rubber layer (for example, a cushioning layer) between the substrate and the topmost laser-engraveable layer. In some embodiments, there can be a capping or smoothing layer that provides additional smoothness or better ink reception disposed over the laser-engraveable layer comprising thermoplastic elastomeric nanocrystalline polyolefin. When such additional layers (and a substrate) are present and it is desired to recycle the flexographic printing member, they are generally stripped from the laser-engraved layer containing the nanocrystalline polyolefin so that laser-engraved layer can be readily melted and recycled.

The laser engraveable flexographic printing precursor or patternable material can be prepared in various ways, for example, by coating, or spraying the laser-engraveable layer formulation onto the substrate out of a suitable solvent and drying. Alternatively, the laser-engraveable layer(s) can be press-molded, injection-molded, melt extruded, extruded then calendered, or co-extruded into an appropriate layer or ring (sleeve) and adhered or laminated to the substrate to form a continuous layer, flat or curved sheet, or seamless printing sleeve. The layer in sheet-form can be wrapped around a printing cylinder and optionally fused at the edges to form a seamless flexographic printing sleeve.

The laser engraveable flexographic printing precursor can be subjected to mechanical grinding by known methods in the art using commercially available machines such as belt grinders, cylindrical grinders using an abrasive wheel, or paper. Grinding can be done on either the laser-engravable surface or to the non-laser-engraveable surface in order to ensure thickness uniformity, or it can be done on the laser-engravable surface to achieve a desired surface roughness that will improve printing ink wetting and transfer.

The laser-engraveable flexographic printing precursor can also be constructed with a suitable protective layer or slip film (with release properties or a release agent) in a cover sheet that is removed prior to laser engraving. Such protective layers can be a polyester film [such as poly(ethylene terephthalate)], a polyethylene or similar film, to form a cover sheet.

Laser-Engraving and Printing

A relief image can be provided in a flexographic printing member by laser-engraving a suitable flexographic printing precursor using laser-engraving radiation. Such precursors can be used to form flexographic printing plates, flexographic printing sleeves, or flexographic printing cylinders.

Imaging of the flexographic printing precursor to provide the desired relief image can be achieved using one or more suitable laser diodes (for example infrared laser diodes). The resulting flexographic printing member can have a relief image with a geometric feature, or a plurality of relief features, or it can have a relief image that is irregular in shape or appearance.

Engraving energy is generally applied using a suitable imaging laser or laser array such as, but not limited to, a gas laser for example $CO_2$ laser, near-infrared lasers such as near-infrared radiation-emitting diodes, arrays of laser diodes, Nd-YAG lasers, fiber semiconductive lasers, fiber-coupled semiconductive laser diodes, or other laser array. Engraving to provide a relief image with a depth of at least 100 μm is desired with a relief image having a maximum depth of from about 300 to about 1000 μm being more desirable. It is understood that the depth between image features that are closely spaced will be less than the maximum depth. The relief image can have a maximum depth up to about 100% of the original thickness of the laser-engraveable layer when a substrate or non-engraveable layer is present under the laser-engraveable layer. In such instances, the floor of the relief image can be the substrate if the laser-engraveable layer is completely removed in the imaged regions. If a substrate is not used, the relief image can have a maximum depth up to about 80% of the original thickness of the laser-engraveable layer.

A laser operating at a wavelength of at least 700 nm is generally used, and a laser operating at a wavelength of at least 800 nm and up to and including 1250 nm is particularly useful. The laser should have a high enough intensity that the pulse or the effective pulse caused by relative movement between the laser and the precursor is deposited approximately adiabatically during the pulse. Generally, laser-engraving is achieved using at least one laser providing a minimum fluence level of at least 1 J/cm$^2$ at the precursor topmost surface and typically infrared laser-engraving is carried out at an energy of at least 20 J/cm$^2$ and up to and including 1000 J/cm$^2$ or at least 50 J/cm$^2$ and up to and including 1500 J/cm$^2$.

For example, laser-engraving can be carried out using a diode laser, an array of diode lasers connected with fiber optics, a Nd-YAG laser, a fiber laser, a carbon dioxide gas laser, or a semiconductor laser. Such instruments and conditions for their use are well known in the art and readily available from a number of commercial sources. Detailed descriptions can be found in U.S. Patent Application Publications 2010/0068470A1 (Sugasaki), 2008/018943A1 (Eyal et al.), and 2011/0014573A1 (Matzner et al.), all hereby incorporated by reference.

Laser-engraving a relief image can occur in various contexts. For example, sheet-like flexographic printing precursors can be imaged and used as desired, or wrapped around a printing cylinder or cylinder form before imaging. The flexographic printing precursor can also be a printing sleeve that can be mounted directly into a laser imaging device.

During imaging, most of the removed products of engraving are combinations of particulate and gaseous or volatile components and are readily collected by vacuum for disposal or chemical treatment. Any residual solid debris on the engraved member can be similarly collected using vacuum or washing.

After imaging, the resulting flexographic printing member can be subjected to an optional detacking step if the elastomeric topmost surface is still tacky, using methods known in the art.

During printing, the resulting flexographic printing member is inked using known methods and the ink is appropriately transferred to a suitable receiver element such as paper, plastics, fabrics, paperboard, or cardboard using a flexographic printing press.

The imaged printing plate or printing sleeve can be cleaned and the engraved surface melted and recycled (see below). The laser-engraved layer comprising the thermoplastic elastomeric nanocrystalline polyolefin of a laser-engraved flexographic printing member can be melted and recycled before printing for example if a defect is observed in the relief image.

Recycling Processes

Before or after printing, the flexographic printing member can be cleaned and reused and a printing cylinder can be scraped or otherwise cleaned and reused by recycling the laser-engraveable layer (before imaging) or laser-engraved layer (after imaging). For example, a laser-engraveable layer can be melted and recycled before it is engraved if there is an undesirable defect in the layer. Alternatively, it can be recycled after engraving but before printing if the engraving process creates an error or there is a need for correction in the image. Lastly, the engraved layer can be recycled after a printing run is finished. Alternatively, a flexographic printing sleeve can be remolded and reshaped by melting the thermoplastic elastomeric nanocrystalline polyolefin layer to allow the imaged and non-imaged areas to merge and create a fresh uniform surface that will become a flexographic printing precursor when cooled. Optionally, this fresh surface can be ground, as described above. The fresh surface can then be exposed to laser ablation and the new image printed.

Before melting, the laser-engraveable layer or laser-engraved layer can be separated from all other layers and any substrate present in the flexographic printing precursor or flexographic printing plate.

The following representative process can be used to recycle or reuse a laser-engraved member of this invention:

1. Physically separating the thermoplastic elastomeric nanocrystalline polyolefin layer composition described herein from the substrate and any other layers that are present and cleaning to remove any residual ink or debris;
2. Chopping, cutting, or grinding the thermoplastic elastomeric nanocrystalline polyolefin layer composition into a form, such as small pieces or a powder, that is readily processable;
3. Feeding the small pieces or powder into a melt compounder or extruder, or other appropriate apparatus set to an appropriate processing temperature to form a melt; and
4. Extruding, calendering, or molding the melt into a new flexographic plate precursor.

The following alternate representative process can be used to recycle or reuse a laser-engraved flexographic printing member of this invention.

1. Physically separating the thermoplastic elastomeric nanocrystalline polyolefin layer composition described herein from the substrate and any other layers that are present and cleaning to remove any residual ink or debris;
2. Dissolving the thermoplastic elastomeric nanocrystalline polyolefin layer composition into a suitable solvent or solvent mixture to form a solution;
3. Coating, spraying, or pouring this solution onto a suitable substrate to form a layer or multiple layers; and
4. Drying the coated layer or layers to provide a new flexographic plate precursor.

Still another representative process that can be used to recycle or re-use a laser-engraved flexographic printing sleeve of this invention comprises:

1. Mounting the used sleeves on a suitable rotating holder and cleaning the surface to remove any residual ink or debris;
2. Scraping or shaving off, for example as the unit rotates to ensure uniformity, the desired amount of the outer layer of the thermoplastic elastomeric nanocrystalline polyolefin layer;
3. Collecting the removed material and feeding it into a melt compounder or extruder, or other appropriate apparatus set to an appropriate processing temperature to form a melt;
4. Extruding the melt into a new flexographic printing precursor, or onto a used, scraped flexographic printing sleeve; and
5. Optionally grinding the new surface to provide a desired surface roughness and uniform thickness of the flexographic sleeve precursor.

Still another process for recycling or re-using a laser-engraved flexographic printing sleeve of this invention comprises:

1. Mounting a used sleeve onto a suitable rotating holder and cleaning the surface to remove any residual ink or debris;
2. Heating the outer layer of the thermoplastic elastomeric nanocrystalline polyolefin layer of the sleeve to melt the engraved features;
3. Reshaping the outer surface of the flexographic printing sleeve using heat to form a smooth uniform surface; and
4. Optionally grinding the new surface to provide a desired surface roughness and uniform thickness of the flexographic printing sleeve precursor.

Equipment that can be used to effect the steps of the recycling process described above include, but are not limited to, single-screw extruders, twin-screw extruders, extruders equipped with dies, Brabender compounders, injection molders, calendering units, single or twin screw augers, compounding extrusion units, pelletizing units, sheet extrusion units, chopping and regrinding units. Other equipment includes solution coating machines and drying units.

The flexographic printing precursor can be part of a system that is designed for laser-engraving such flexographic printing plate precursors to form flexographic printing members. Besides the precursors, the system can include, at least, one or more laser-engraving radiation sources that are directed to provide laser engraving of the laser-engraveable layer. Useful laser-engraving sources are described above and additional sources would be readily apparent to one skilled in the art. One useful system is described in U.S. Patent Application Publication 2011/0014573 (noted above) that is incorporated herein by reference. Such laser-engraving system includes one or more laser-engraving radiation sources and particularly two groups of laser-engraving radiation sources when the precursor has two laser-engraveable layers.

The system can further comprise a platform on which the laser-engraveable flexographic printing precursor is mounted for laser-engraving. Such platforms can include for example, webs (moving or not moving), cylinders, or rotating drums. The laser-engraving radiation sources (for example, IR radiation sources) can be provided as one or more lasers for example from a hybrid optical imaging head having at least two groups of radiation sources as described for example in U.S. Patent Application Publication 2008/0153038 (Simantov et al.), incorporated herein by reference, that are controlled using suitable control devices.

The one or more laser-engraving radiation sources can be selected from the group consisting of laser diodes, multi-emitter laser diodes, laser bars, laser stacks, fiber lasers, and a combination thereof. In particular embodiments, the laser-engraveable layer of the precursor comprises an infrared radiation absorber and the one or more laser-engraving radiation sources provide infrared radiation.

Other systems for providing relief images by laser-engraving are described for example in U.S. Pat. Nos. 6,150,629 (Sievers) and 6,857,365 (Juffinger et al.) and in U.S. Patent Application Publications 2006/0132592 (Sievers), 2006/0065147 (Ogawa), 2006/0203861 (Ogawa), and 2008/0153038 (noted above), 2008/018943A1 (noted above), and 2011/0014573A1 (noted above).

The present invention provides at least the following embodiments and combinations thereof, but other combinations of features are considered to be within the present invention as a skilled artisan would appreciate from the teaching of this disclosure:

1. A method for recycling comprising:

melting a laser-engraveable layer of a flexographic printing precursor or a laser-engraved layer of a flexographic printing plate, the laser-engraveable layer or laser-engraved layer comprising a thermoplastic elastomeric nanocrystalline polyolefin, to form a melt, and reforming the melt into a new laser-engravable flexographic printing precursor.

2. The method of embodiment 1 wherein the laser-engraveable layer or laser-engraved layer comprises at least 30 weight % and up to and including 100 weight % of the thermoplastic elastomeric nanocrystalline polyolefin.

3. The method of embodiment 1 or 2 wherein the nanocrystalline polyolefin is present in the laser-engraveable layer or laser-engraved layer in an amount of at least 30 weight % and up to and including 99 weight % of the total polymeric materials.

4. The method of any of embodiments 1 to 3 wherein the laser-engraveable layer or laser-engraved layer comprises less than 0.1 weight % of chemical crosslinking agents.

5. The method of any of embodiments 1 to 4 wherein laser-engraveable layer or laser-engraved layer is essentially free of polymers containing pendant styrene or substituted styrene groups.

6. The method of any of embodiments 1 to 5 wherein the thermoplastic elastomeric nanocrystalline polyolefin has a glass transition temperature less than or equal to 10° C.

7. The method of any of embodiments 1 to 6 wherein the thermoplastic elastomeric nanocrystalline polyolefin is a copolymer comprising at least two different randomly ordered olefin recurring units.

8. The method of any of embodiments 1 to 7 wherein the thermoplastic elastomeric nanocrystalline polyolefin contains at least propylene recurring units.

9. The method of any of embodiments 1 to 8 wherein the laser-engraveable layer or laser-engraved layer comprises a mixture of one or more thermoplastic elastomeric nanocrystalline polyolefins and one or more non-nanocrystalline polyolefins.

10. The method of embodiment 10 wherein the laser-engraveable layer or laser-engraved layer comprises a mixture of a thermoplastic elastomeric nanocrystalline polyolefin and a non-nanocrystalline polypropylene.

11. The method of any of embodiments 1 to 10 wherein the laser-engraveable layer or laser-engraved layer further comprises a radiation absorber in an amount of at least 0.5 weight %.

12. The method of any of embodiments 1 to 11 wherein the laser-engraveable layer or laser-engraved layer further comprises a carbon black, an inorganic or organic pigment, carbon nanotubes, graphene, an organic dye having a $\lambda_{max}$ of at least 800 nm, or any combination of these, as a radiation absorber.

13. The method of any of embodiments 1 to 12 wherein the laser-engraveable layer or laser-engraved layer further comprises chemically inactive particles or microcapsules in an amount of at least 2 weight %.

14. The method of any of embodiments 1 to 13 comprising melting a laser-engraveable layer of a flexographic printing precursor.

15. The method of any of embodiments 1 to 13 comprising melting a laser-engraved layer of a flexographic printing member.

16. The method of any of embodiments 1 to 15 wherein the flexographic printing precursor or flexographic printing plate further comprises a substrate on which the laser-engravable layer or laser-engraved layer is disposed.

17. The method of any of embodiments 1 to 16 further comprising:

before melting, separating the laser-engraveable layer or laser-engraved layer from all other layers and any substrate present in the flexographic printing precursor or flexographic printing plate.

18. The method of any of embodiments 1 to 16 further comprising:

before melting, scraping or shaving off the desired amount of the outer layer of the thermoplastic elastomeric nanocrystalline polyolefin layer of a flexographic printing sleeve.

The following Examples are provided to illustrate the practice of this invention and are not meant to be limiting in any manner.

Invention Example 1

Thermoplastic elastomeric (TPE) nanocrystalline polyolefm pellets (42.0 g, NOTIO PN-2060 from Mitsui Chemicals America, Inc. Rye Brook, NY) were combined with carbon black powder (3.2 g, Mogul® L from Cabot Corp Boston, MA) and melt mixed in a Brabender mixer (ATR-2120 equipped with 3 heat zones and high shear roller type blades) at 200° C. for 10 minutes at 45 rpm, removed, and allowed to cool. This resulted in laser-engraveable layer composition having a 93 weight % of NOTIO PN-2060 and 7 weight % of carbon black. A sample (3.5 g) of this mixture was introduced into an aluminum mold with 300FN KAPTON on one side for ease of release, and was pressed into the shape of a flat article using a Carver press (model #3393) set at 20 megapascals at 220° C. for 5 minutes. The assembly of the mold and its contents were then cold-pressed in another Carver press that was set at 20 megapascals pressure with no heating for 30 minutes. The resulting laser-engraveable flexographic printing plate precursor of this invention was 75×75 mm in size and approximately 0.8 mm thick.

The laser-engravable plate precursor was laser-engraved (imaged) using a 5.3 watt, 1064 nm pulsed single mode ytterbium fiber laser with an 80 μm spot size. The pulse width was approximately 30 nsec and the pulse repetition rate was 20 kHz. The imaged contained 1 cm×1 cm patches that were rastered at 800 dpi using laser beam speeds of from 13 to 6.5 inch/sec (33.02 to 16.5 cm/sec) resulting in corresponding fluences of from 51 J/cm$^2$ to 102 J/cm$^2$. The depth of the ablated patches was measured using a self non-rotating spindle using a ratchet stop micrometer and when the laser fluence was 102 J/cm$^2$, the depth was 233 μm.

To demonstrate how this engraved flexographic printing plate can be recycled, it was then cut into 5-10 mm size pieces using scissors. These pieces were weighed and additional laser-engraveable layer composition described above was added to these pieces until the total weight was 3.5 grams that were introduced into an aluminum mold with 300FN KAPTON on one side for ease of release, and pressed into the shape of a flat article using a Carver press (model #3393) set at 20 megapascals at 220° C. for 5 minutes. The assembly of the mold and its contents were then cold-pressed in another Carver press that was set at 20 megapascals pressure with no heating for 30 minutes. The resulting laser-engraveable flexographic printing plate precursor was 75×75 mm in size and approximately 0.8 mm thick. This laser-engravable plate precursor formed of recycled material was imaged using the same laser as described above. The value for the relief image depth engraved when the laser fluence was 102 J/cm$^2$ was 228 μm.

Invention Examples 2-8

Additional flexographic printing plate precursors prepared as described herein and having a laser-engraveable layer were prepared using melt molding, laser engraved using a 5.3 watt, 1064 nm pulsed single mode ytterbium fiber laser with a resulting ratio of TPE nanocrystalline polyolefin to carbon black of 93:7 by weight, and the product designation of the nanocrystalline polyolefins (NOTIO products were from Mitsui Chemicals America, Inc. Rye Brook, NY and ENGAGE products were from Dow Chemical) was varied, as shown below in TABLE I. The values for the relief image depths engraved when the laser fluence was 102 J/cm$^2$ are also recorded in TABLE I.

Laser Engraving:

The laser-engravable flexographic printing plate precursors were imaged using a 5.3 watt, 1064 nm pulsed single mode ytterbium fiber laser with an 80 μm spot size. The pulse width was approximately 30 nsec and the pulse repetition rate was 20 kHz. The images contained 1 cm×1 cm patches that were rastered at 800 dpi using laser beam speeds of from 13 to 6.5 inch/sec (33.02 to 16.5 cm/sec) resulting in corresponding fluences of from 51 J/cm$^2$ to 102 J/cm$^2$. The depths of the ablated patches were measured using a self non-rotating spindle using a ratchet stop micrometer. The engraved image depth engraved when the laser fluence was 102 J/cm$^2$ was 240 μm as indicated in TABLE I.

Rheological Test for Invention Example 2:

A flexographic printing plate precursor sample of the thermoplastic elastomeric nanocrystalline polyolefin was prepared the same as described in Invention Example 2. A 25 mm diameter disc was punched out of the precursor sample using a knife edged bore. The sample disk was loaded into a Rheometrics RMS-800 mechanical spectrometer (from TA Instruments, DE, USA). The viscous and elastic responses of the precursor sample were determined by small amplitude oscillatory motion using 25 mm parallel plate geometry. For crosslinked materials, modified parallel plate geometry (serrated plates with 0.25 mm deep cutouts) was used to prevent slippage of the precursor sample at the plate. A small calibration factor was determined to relate the serrated plate response to the parallel plate response. In all instances, the sample disc was loaded between the precursors at room temperature, heated to 200° C., and equilibrated. During the temperature ramping, thermal expansion was monitored to ensure that the normal force stayed below 1000 g. At the measurement temperature of 200° C., the normal force was maintained at less than 100 g by adjusting the precursor separation, a low applied strain was used to ensure that the response was in the linear viscoelastic regime, and the torque was high enough to provide adequate signal intensity. Several different strain amplitudes were used to determine the optimal settings. During the rheological characterization, the probe frequency of oscillation applied to the precursor sample was varied from 100 radians/second to 0.1 radians/second in equal logarithmic steps using strain control and the moduli (G' and G") were measured at each frequency. FIG. 1 shows the frequency responses of G' and G" moduli for the precursor sample, plotted logarithmically. This representation fully characterizes the viscoelastic response of the materials. Alternatively, one could display data in an equivalent representation: Complex Viscosity and damping factor (also called loss tangent).

Comparative Example 1

A flexographic printing plate precursor was prepared, molded, and laser engraved using a 5.3 watt, 1064 nm pulsed single mode ytterbium fiber laser, and subjected to the swell test, as described above except that the resulting ratio of binder to carbon black was 93:7 by weight and the binder was non-nanocrystalline, semi-crystalline polypropylene (Isotactic, Mn=250,000, Product #182389 from Sigma-Aldrich St. Louis, Mo.). The value for the depth engraved when the laser fluence was 102 J/cm$^2$ is recorded below in TABLE I. The precursor was very hard and did not show elastomeric properties. In addition, severe melt edges were observed at the edges of features in the laser-ablated flexographic printing member.

Comparative Example 2

A styrene-butadiene triblock copolymer TPE (4.7 g, Kraton D1102K with 28% polystyrene content from Kraton Polymers LLC, Houston, Tex.) was combined with carbon black powder (0.3 g, Mogul® L from Cabot Corp Boston, Mass.) and melt mixed in a ThermoHaake twin screw extruder (Model MiniLab Rheomix CTW5) at 190° C. for 5 minutes at 60 rpm, flushed from the extruder, and allowed to cool. This resulted in a 94 weight % of Kraton and 6 weight % of carbon black. A sample (3.5 g) of this mixture was melt molded to form a laser-engraveable layer, laser engraved using a 5.3 watt, 1064 nm pulsed single mode ytterbium fiber laser. The value for the relief image depth engraved when the laser fluence was 102 J/cm$^2$ is recorded below in TABLE I. Kraton is a non-nanocrystalline TPE and showed an unacceptable level of solvent swell.

Comparative Example 3

A commercially available flexographic printing plate precursor, Flexcel® NX (Eastman Kodak Company, thickness of 2.7 mm), was uniformly exposed (imaged) using UV radiation to induce crosslinking with backside and frontside exposure times and energies, and was processed (developed) using the processing conditions recommended in the product specifications. The PET support was removed from the resulting flexographic printing plate and the rheological test described above was repeated. The frequency responses of G' and G" moduli for this material are shown in FIG. 1.

Comparative Example 4

A commercially available vulcanized rubber flexographic printing plate precursor (Bottcher Flex 787, thickness of 1.7 mm) was obtained from Bottcher Systems (Germany). The PET support was removed from the precursor sample and the rheological test described above was repeated. The frequency responses of G' and G" moduli for this precursor are shown in FIG. 1.

FIG. 1 shows that for the precursor of Invention Example 2, the values of the storage and loss moduli, G' and G" respectively, when plotted in a log-log format, decreased continuously as the frequency of oscillation was decreased in the terminal zone, with slopes near or greater than 1, indicating that the Invention Example 2 precursor is melt processable. On the other hand, for the chemically crosslinked precursors of Comparative Examples 3 and 4, the G' and G" moduli approach a slope of zero as the frequency of oscillation is varied, indicating that they are crosslinked and not melt processable, as defined for the present invention.

TABLE I

| Precursor Example | Binder | Binder-Carbon Black Ratio | Patch Depth at 102 J/cm$^2$ Fluence | Elasticity |
|---|---|---|---|---|
| Invention 2 | Notio ™ PN-2060 | 93/7 | 236 | good |
| Invention 3 | Notio ™ PN-0040 | 93/7 | 258 | good |
| Invention 4 | Notio ™ PN-20300 | 93/7 | 245 | good |
| Invention 5 | Notio ™ PN-2070 | 93/7 | 224 | good |
| Invention 6 | Notio ™ PN-3560 | 93/7 | 258 | good |
| Invention 7 | Engage ™ 8200 | 93/7 | 192 | good |
| Invention 8 | Engage ™ 8401 | 93/7 | 181 | good |
| Comparative 1 | Polypropylene | 93/7 | 207 | poor |
| Comparative 2 | Kraton D1102K | 94/6 | 227 | good |

The results shown in TABLE I demonstrate that a combination of excellent properties of high quality laser-ablative imaging and good elasticity are achieved when the nanocrystalline polyolefin is used as the binder in the laser-engraveable layer of a flexographic printing plate precursor. When a non-nanocrystalline polyolefin or a non-crystalline TPE containing styrene were used as the binder in the laser-engraveable layer, the resulting properties were undesirable.

The invention has been described in detail with particular reference to certain preferred embodiments thereof, but it will be understood that variations and modifications can be effected within the spirit and scope of the invention.

The invention claimed is:

1. A method for recycling comprising:

melting a non-chemically crosslinked laser-engraved layer of a flexographic printing plate, the non-chemically crosslinked laser-engraved layer comprising a thermoplastic elastomeric nanocrystalline polyolefin, to form a melt, and reforming the melt into a new laser-engravable flexographic printing precursor, wherein the non-chemically crosslinked laser-engraved layer further comprises a carbon black, an inorganic or organic pigment, carbon nanotubes, graphene, an organic dye having a $\lambda_{max}$ of at least 800 nm, or an combination of these, as a radiation absorber.

2. The method of claim 1 wherein the non-chemically crosslinked laser-engraved layer comprises at least 30 weight % and up to and including 100 weight % of the thermoplastic elastomeric nanocrystalline polyolefin.

3. The method of claim 1 wherein the nanocrystalline polyolefin is present in the non-chemically crosslinked laser-engraved layer in an amount of at least 30 weight % and up to and including 99 weight % of the total polymeric materials.

4. The method of claim 1 wherein the non-chemically crosslinked laser-engraved layer comprises less than 0.1 weight % of chemical crosslinking agents.

5. The method of claim 1 wherein the non-chemically crosslinked laser-engraved layer is essentially free of polymers containing pendant styrene or substituted styrene groups.

6. The method of claim 1 wherein the thermoplastic elastomeric nanocrystalline polyolefin has a glass transition temperature less than or equal to 10° C.

7. The method of claim 1 wherein the thermoplastic elastomeric nanocrystalline polyolefin is a copolymer comprising at least two different randomly ordered olefin recurring units.

8. The method of claim 1 wherein the thermoplastic elastomeric nanocrystalline polyolefin contains at least propylene recurring units.

9. The method of claim 1 wherein the non-chemically crosslinked laser-engraved layer comprises a mixture of one or more thermoplastic elastomeric nanocrystalline polyolefins and one or more non-nanocrystalline polyolefins.

10. The method of claim 1 wherein the non-chemically crosslinked laser-engraved layer comprises a mixture of a thermoplastic elastomeric nanocrystalline polyolefin and a non-nanocrystalline polypropylene.

11. The method of claim 1 wherein the non-chemically crosslinked laser-engraved layer comprises the radiation absorber in an amount of at least 0.5 weight %.

12. The method of claim 1 wherein non-chemically crosslinked laser-engraved layer further comprises chemically inactive particles or microcapsules in an amount of at least 2 weight %.

13. The method of claim 1 wherein the flexographic printing plate further comprises a substrate on which the non-chemically crosslinked laser-engraved layer is disposed.

14. The method of claim 1 further comprising:

before melting, separating the non-chemically crosslinked laser-engraved layer from all other layers and any substrate present in the flexographic printing plate.

15. The method of claim 1 further comprising:

before melting, scraping or shaving off a desired amount of the non-chemically crosslinked laser-engraved layer of a flexographic printing sleeve.

* * * * *